US006201201B1

(12) United States Patent
Wu

(10) Patent No.: US 6,201,201 B1
(45) Date of Patent: Mar. 13, 2001

(54) ELECTRICAL SWITCH

(76) Inventor: Chi Man Wu, No. 2, 11th Floor, Wah Wai Industrial Building, 53-61 Pak Tin Pa Street, Tsuen Wan, New Territories (HK)

( * ) Notice: Subject to any disclaimer, the term of this patent is extended or adjusted under 35 U.S.C. 154(b) by 0 days.

(21) Appl. No.: 09/503,085

(22) Filed: Feb. 14, 2000

(51) Int. Cl.[7] ..... H01H 5/00

(52) U.S. Cl. ..... 200/405; 200/6 R; 200/467; 200/553; 200/339

(58) Field of Search ..... 200/6 R, 6 B, 200/6 BA, 6 BB, 6 C, 402, 405, 407–409, 440, 441, 442, 445, 449, 450, 453, 459, 460, 461, 462, 463, 464, 467, 553, 558, 559, 339

(56) References Cited

U.S. PATENT DOCUMENTS

| | | | | |
|---|---|---|---|---|
| 3,165,603 | * | 1/1965 | Sorenson | 200/67 |
| 4,136,268 | | 1/1979 | Rose | 200/17 R |
| 4,894,500 | | 1/1990 | Yamazaki et al. | 200/565 |
| 5,836,443 | | 11/1998 | Gernhardt et al. | 200/557 |

FOREIGN PATENT DOCUMENTS

| | | | |
|---|---|---|---|
| 1-272014 | 10/1989 | (JP) | H01H/3/14 |
| 8-249983 | 9/1996 | (JP) | H01H/3/14 |
| 8-315682 | 11/1996 | (JP) | H01H/21/00 |
| 9-73841 | 3/1997 | (JP) | H01H/23/16 |

* cited by examiner

*Primary Examiner*—Michael Friedhofer
(74) *Attorney, Agent, or Firm*—Leydig, Voit & Mayer, Ltd

(57) ABSTRACT

An electrical switch for switching on and off an electrical appliance such as a light bulb. The switch includes a body, a fixed contact and a movable contact, an actuator supported by the body for pivotal movement, causing movement of the movable contact between a switched-on position and a switched-off position, and an internal spring acting upon the actuator. The spring extends generally in-line with the actuator, in compression, such that the actuator and spring are pivotable rapidly and simultaneously in opposite directions through an over-centre action about an unstable central position. The body may include a lamp socket for receiving the light bulb.

17 Claims, 1 Drawing Sheet

ELECTRICAL SWITCH

SUMMARY OF THE INVENTION

According to the invention, there is provided an electrical switch for switching on and off an electrical appliance, which switch comprises a body, a fixed contact and a movable contact, an actuator supported by the body for pivotal movement to cause movement of the movable contact between a switched-on position and a switched-off position, and an internal spring acting upon the actuator, said spring extending generally in-line with the actuator and is in compression such that the actuator and spring are pivotable rapidly and simultaneously in opposite directions through an over-centre action about an unstable central position.

Preferably, the movable contact is normally in the switched-off position, and the actuator is pivotable in one direction to move the movable contact into the switched-on position and in the opposite direction to release the movable contact from the switched-on position.

Preferably, the actuator and spring are both elongate and flippable through said over-centre action.

In a preferred embodiment, the actuator has an external part for manual operation, an internal part in engagement with the spring and for causing movement of the movable contact, and an intermediate part about which the actuator is hinged to the body.

It is preferred that the intermediate part of the actuator is slidable to a limited extent in said opposite directions for bending the spring in order to facilitate pivoting of the actuator and spring through said over-centre action.

More preferably, the intermediate part of the actuator is in the form of a hinge pin, and the body has an internal recess slidably receiving the hinge pin.

It is preferred that the spring is in engagement with the internal part of the actuator by means of a coupler which is slidable to a limited extent in said opposite directions relative to the actuator part for stabilising the position of the actuator.

It is preferred that a spring is provided on the internal part of the actuator for acting upon the movable contact.

It is preferred that the body includes a pair of opposed parts for hitting by the internal part of the actuator pivoting in said opposite directions, thereby making a sound indicative of the movable contact reaching either the switched-on or switched-off position respectively.

More preferably, the internal part of the actuator incorporates a spring on one side for holding the movable contact in the switched-on position when said internal part is initially departing from one of said opposed parts until substantially the moment when the opposite side of said internal part hits the other of said opposed parts, whereby the sound so made is indicative of the movable contact reaching the switched-off position.

More preferably, the body is provided with a pair of power pins having internal ends providing the opposed parts respectively.

Further more preferably, the fixed contact is connected to one of the power pins and the movable contact is movable by the actuator to come into contact with the other power pin.

Further more preferably, the body includes a lamp socket for receiving a light bulb for lighting.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 2:
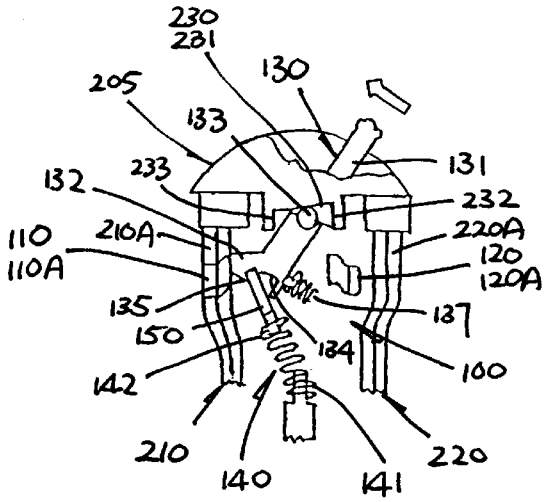
FIGS. 2, 3, and 4 are cross-sectional bottom views of the lamp socket of FIG. 1, showing sequentially the operation of the switch to turn on the light bulb.
Figure 1:
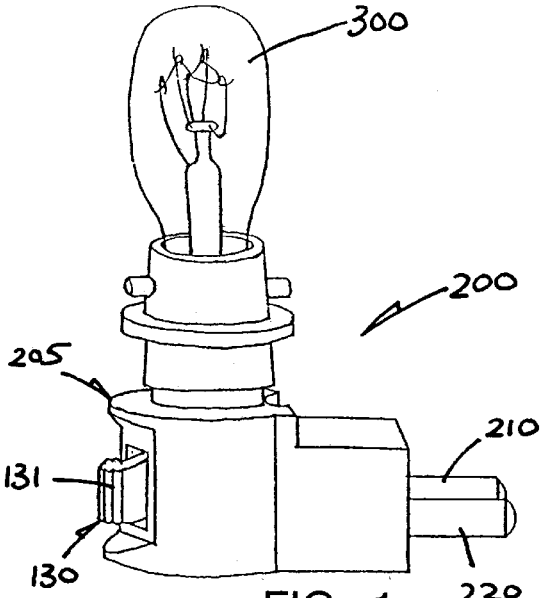
FIG. 1 is a perspective view of an embodiment of an electrical switch in accordance with the invention, said switch being incorporated in a lamp socket which is provided with a pair of power pins and supports a light bulb.

Referring to the drawings, there is shown an electrical switch 100 embodying the invention, which is incorporated in a lamp socket 200 having a body 205 provided with a pair of opposed horizontal neutral and live power pins 210 and 220 and supporting a central light bulb 300 atop. The power pins 210 and 220 have respective inner ends 210A and 220A located within the lamp socket body 205. The switch 100 comprises a pair of generally vertical fixed and movable strip-like contacts 110 and 120, a horizontal elongate actuator 130 for moving the movable contact 120, and a horizontal coil spring 140 acting upon the actuator 130.

The fixed contact 110 has an upper end which constitutes one terminal of the lamp socket 200 for contacting the side terminal of the light bulb 300 and a lower end 110A which is permanently connected to the neutral pin end 210A. The movable contact 120 has an upper end which constitutes the other terminal of the lamp socket 200 for contacting the end terminal of the light bulb 300 and a lower end 120A which extends in a cantilever manner to reach transversely adjacent, normally at a small distance from, the inner side of the live pin end 220A.

In operation, the movable contact end 120A is pivotable by the actuator 130 to come into contact with the live pin end 220A (FIG. 4) for switching on the light bulb 300 or, alternatively, releasable by the actuator 130 to move away from the live pin end 220A (FIG. 2 or 6) for switching off the light bulb 300.

The actuator 130 has an external end 131 for manual operation from outside the lamp socket body 205, a laterally expanded internal end 132, and a pair of intermediate hinge pins 133 on opposite sides pivotably supporting the overall actuator 130 to the lamp socket body 205. The spring 140 has a first end 141 which is fixed and a second end 142 which engages with the actuator end 132 by means of a coupler 150. The spring 140 extends generally in-line with the actuator 130 and is in compression such that the two components are flippable rapidly and simultaneously in opposite directions (left and right) through an over-centre action about an unstable central or co-linear position.

The lamp socket body 205 has internally a pair of flat recesses 230 on opposite sides, which face the spring 140 beyond the actuator 130 and loosely receive the respective hinge pins 133 of the actuator 130 for limited sliding movement. Each recess 230 has a straight bottom which is inclined relative to the aforesaid co-linear position (of the actuator 130 and spring 140) to form a slightly sloped track 231 for the corresponding hinge pin 133 to slide along it. More specifically, each track 231 is inclined to the right side of the aforesaid co-linear position, thereby resulting in the respective recess 230 having a deeper right side 232 and a shallower left side 233.

The actuator end 132 has a recess 134 having left and right sides 135 and 136. The coupler 150, which is supported at the second end 142 of the spring 140, is generally U-shaped and inter-engages with the actuator recess 134 in a cross manner such that the coupler 150 is slidable across the recess 134 between opposite sides 135 and 136. A small coil spring 137 is attached on the right side of the actuator end 132.

In the switched-off condition of the switch 100 (FIG. 2 or 6), the actuator end 132 pivots to the left and is urged against the neutral pin end 210A by the spring 140 bent also to the left. The actuator 130 stays in this position, with its hinge pins 133 reaching near the right sides 232 of the recesses 2 30.

Figure 3:
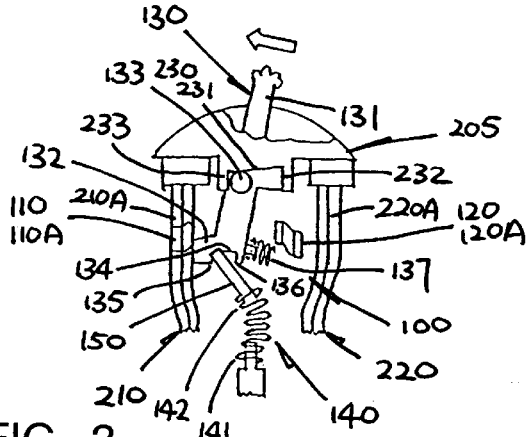
Figure 4:
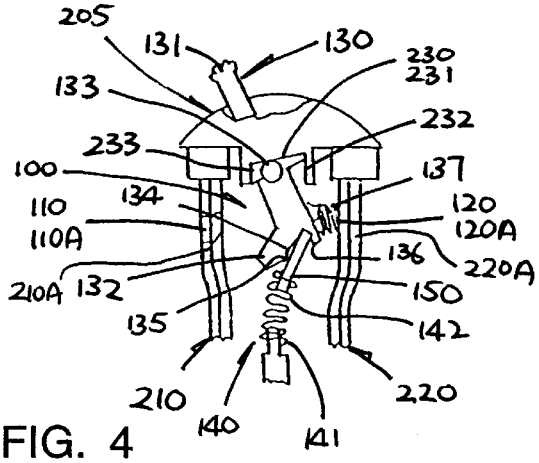

Manual flipping of the actuator 130 anti-clockwise will turn the switch 100 into the switched-on condition (FIG. 4). When force is first applied to the external end 131, the actuator 130 will not flip initially but turn slightly with its hinge pins 133 sliding along the tracks 231 to the left sides 233 of the recesses 230, and this results in loading or bending of the spring 140 to the right (FIG. 3). Continued application of the force will cause the actuator 130 to flip rapidly, with its internal end 132 swinging to the right and thus pushing the movable contact end 120A into contact with the live pin end 220A (FIG. 4). When the spring 140 flips over simultaneously, the coupler 150 is urged to slide across the actuator recess 134 to the same (right) side 136, thereby allowing the spring end 142 to move slightly further to the right and hence stabilising the position of the actuator 130.

A sound will be made when the actuator end 132 hits the live pin end 220A, which is indicative of the switched-on condition being reached. The small spring 137 on the actuator end 132 is useful for absorbing vibration to avoid or minimise contact bouncing between the movable contact end 120A and the live pin end 220A. In the switched-on condition (FIG. 4), the actuator end 132 pivots to the right and is urged against the live pin end 220A by the spring 140 bent also to the right. The actuator 130 stays in this position, with its hinge pins 133 reaching near the left sides 233 of the recesses 230.

Figure 5:
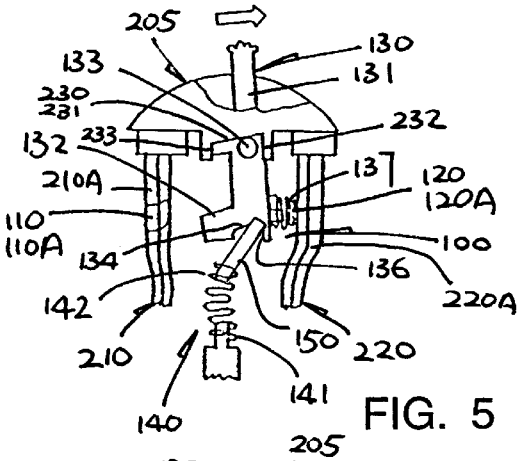
FIGS. 5 and 6 are cross-sectional bottom plan views of the lamp socket of FIG. 1, showing sequentially the operation of the switch to turn off the light bulb.
Figure 6:
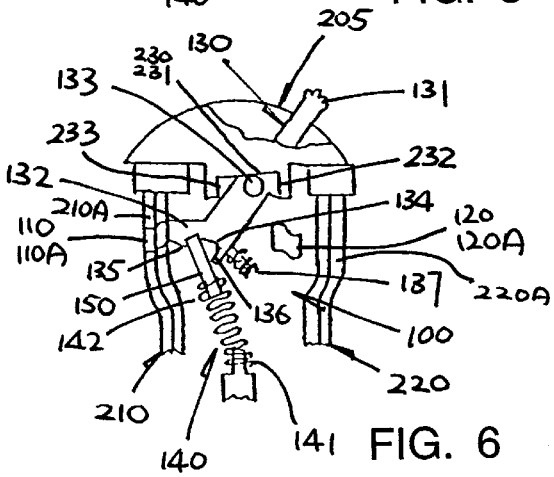

Manual flipping of the actuator 130 clockwise will return the switch 100 back to the switched-off condition (FIG. 6 or 2). When force is first applied to the external end 131, the actuator 130 will not flip initially but turn slightly with its hinge pins 133 sliding along the tracks 231 to the right sides 232 of the recesses 230, and this results in loading or bending of the spring 140 to the left (FIG. 5). Continued application of the force will cause the actuator 130 to flip rapidly, with its internal end 132 swinging to the left and thus releasing the movable contact end 120A from the live pin end 220A (FIG. 6). When the spring 140 flips over simultaneously, the coupler 150 is urged to slide across the actuator recess 134 to the same (left) side 135, thereby allowing the spring end 142 to move slightly further to the left and hence stabilising the position of the actuator 130.

The small spring 137 is useful to assist departure of the actuator end 132 from the live pin end 220A. More importantly, while the actuator end 132 is initially departing from the live pin end 220A, the spring 137 continues to hold the movable contact end 120A in contact with the live pin end 220A (FIG. 5). Such a contact will remain until substantially the moment when the actuator end 132 hits the neutral pin end 210A (FIG. 6), thereby making a sound which is indicative of the switched-off condition being reached.

It is envisaged that the switch 100 may be manufactured as an independent switch and/or used for switching on and off any other electrical appliance.

The invention has been given by way of example only, and various modifications of and/or alterations to the described embodiment may be made by persons skilled in the art without departing from the scope of the invention as specified in the appended claims.

What is claimed is:

1. An electrical switch for switching on and off an electrical appliance comprising:

a body, a fixed contact and a movable contact, an actuator supported by the body for pivotal movement, causing movement of the movable contact between a switched-on position and a switched-off position, wherein the actuator has an external part for manual operation, and an internal part for causing movement of the movable contact, and an intermediate part about which the actuator is hinged to the body, a first internal spring engaging the internal part of the actuator and acting upon the actuator, the first internal spring extending generally in-line with the actuator, in compression, such that the actuator and spring are pivotable simultaneously in opposite directions through an over-centre action about an unstable central position, and a second internal spring incorporated in the internal part and bearing on one side of the internal part for holding the movable contact in the switched-on position when the internal part is initially departing from a first of a pair of opposed parts until an opposite side of the internal part impacts a second of the pair of opposed parts, whereby a sound is produced indicative of the movable contact reaching the switched-off position.

2. The electrical switch as claimed in claim 1, wherein the movable contact is normally in the switched-off position, and the actuator is pivotable in a first direction to move the movable contact into the switched-on position and in a second direction, opposite the first direction, to release the movable contact from the switched-on position.

3. The electrical switch as claimed in claim 1, wherein the actuator and the first internal spring are both elongate and flippable through the over-centre action.

4. The electrical switch as claimed in claim 1, wherein the intermediate part is slidable in opposite directions for bending the first internal spring to facilitate pivoting of the actuator and the first internal spring through the over-centre action.

5. The electrical switch as claimed in claim 4, wherein the intermediate part includes a hinge pin, and the body has an internal recess slidably receiving the hinge pin.

6. The electrical switch as claimed in claim 1, wherein the first internal spring engages the internal part through a coupler slidable in opposite directions relative to the actuator for stabilizing positioning of the actuator.

7. The electrical switch as claimed in claim 1, wherein the body includes the pair of opposed parts for impact by the internal part when pivoting in opposite directions, thereby making the sound indicative of the movable contact reaching the switched-off position.

8. The electrical switch as claimed in claim 1 wherein the body includes a lamp socket for receiving a light bulb.

9. An electrical switch for switching on and off an electrical appliance comprising:

a body including a pair of power pins having internal ends as opposed parts, a fixed contact and a movable contact, an actuator supported by the body for pivotal movement, causing movement of the movable contact between a switched-on position and a switched-off position, the actuator having an external part for manual operation, an internal part for causing movement of the movable contact, and an intermediate part about which the actuator is hinged to the body, and a first internal spring in engagement with the internal part and acting upon the actuator, the first internal spring extending generally in-line with the actuator, in compression, such that the actuator and spring are pivotable simultaneously in opposite directions through an over-centre action about an unstable central position.

10. The electrical switch as claimed in claim 9, wherein the fixed contact is connected to a first of the power pins and the movable contact is movable by the actuator to contact a second of the power pins.

11. The electrical switch as claimed in claim 9, wherein the body includes a lamp socket for receiving a light bulb.

12. The electrical switch as claimed in claim 9, wherein the movable contact is normally in the switched-off position, and the actuator is pivotable in a first direction to move the movable contact into the switched-on position and in a second direction, opposite the first direction, to release the movable contact from the switched-on position.

13. The electrical switch as claimed in claim 9, wherein the actuator and the first internal spring are both elongate and flippable through the over-centre action.

14. The electrical switch as claimed in claim 9, wherein the intermediate part is slidable in opposite directions for bending the first internal spring to facilitate pivoting of the actuator and the first internal spring through the over-centre action.

15. The electrical switch as claimed in claim 14, wherein the intermediate part includes a hinge pin, and the body has an internal recess slidably receiving the hinge pin.

16. The electrical switch as claimed in claim 9, wherein the first internal spring engages the internal part through a coupler slidable in opposite directions relative to the actuator for stabilizing positioning of the actuator.

17. The electrical switch as claimed in claim 9, wherein the opposed parts are impacted by the internal part when the internal part pivots in opposite directions, thereby making a sound indicative of the movable contact reaching one of the switched-on and the switched-off positions.

* * * * *